US008661809B2

(12) United States Patent
Rüb

(10) Patent No.: US 8,661,809 B2
(45) Date of Patent: Mar. 4, 2014

(54) METHOD FOR OPERATING A HYDRAULIC SYSTEM, AND HYDRAULIC SYSTEM

(75) Inventor: Winfried Rüb, Waldshut-Tiengen (DE)

(73) Assignee: Hydac Filtertechnik GmbH, Sulzbach/Saar (DE)

( * ) Notice: Subject to any disclaimer, the term of this patent is extended or adjusted under 35 U.S.C. 154(b) by 1136 days.

(21) Appl. No.: 12/312,470

(22) PCT Filed: Oct. 11, 2007

(86) PCT No.: PCT/EP2007/008831

§ 371 (c)(1),
(2), (4) Date: May 12, 2009

(87) PCT Pub. No.: WO2008/067866

PCT Pub. Date: Jun. 12, 2008

(65) Prior Publication Data

US 2010/0043421 A1 Feb. 25, 2010

(30) Foreign Application Priority Data

Dec. 7, 2006 (DE) ..... 10 2006 057 699

(51) Int. Cl.
*F15B 11/16* (2006.01)

(52) U.S. Cl.
USPC ..... 60/422; 91/512

(58) Field of Classification Search
USPC ..... 60/422; 91/512
See application file for complete search history.

(56) References Cited

U.S. PATENT DOCUMENTS

| | | | | |
|---|---|---|---|---|
| 3,987,622 | A | 10/1976 | Johnson | |
| 5,107,753 | A * | 4/1992 | Ioku | 91/512 |
| 5,319,933 | A * | 6/1994 | Omberg et al. | 91/518 |

FOREIGN PATENT DOCUMENTS

| | | | |
|---|---|---|---|
| DE | 35 32 816 | A1 | 3/1987 |
| DE | 36 03 630 | A1 | 8/1987 |
| DE | 36 44 737 | A1 | 7/1988 |
| DE | 36 44 745 | C2 | 7/1988 |
| DE | 39 01 349 | A1 | 7/1990 |
| DE | 40 41 288 | C1 | 6/1992 |
| DE | 199 57 027 | A1 | 5/2001 |
| JP | 01 269704 | A | 10/1989 |

* cited by examiner

*Primary Examiner* — F. Daniel Lopez
(74) *Attorney, Agent, or Firm* — Roylance, Abrams, Berdo & Goodman LLP

(57) ABSTRACT

A method for operating a hydraulic system has at least one supply device, in particular a hydraulic pump (3) supplying different hydraulic consumers. A synchronizing device (33, 35) ensures that, if at least one hydraulic consumer is not supplied sufficiently, the deficit in volumetric flow for that consumer is compensated such that all the consumers compensate for the deficit equally.

10 Claims, 5 Drawing Sheets

METHOD FOR OPERATING A HYDRAULIC SYSTEM, AND HYDRAULIC SYSTEM

FIELD OF THE INVENTION

The invention relates to a method for operating a hydraulic system having at least one supply device, in particular a hydraulic pump supplying different hydraulic consumers. Moreover, the invention relates to the corresponding hydraulic system.

BACKGROUND OF THE INVENTION

In motor-driven systems and devices with hydraulic systems, for example, in loader-like and excavator-like construction machinery, for reasons of costs, typically the output of the diesel engine is used to drive the hydraulic pump without reserves. Likewise, for reasons of costs, in many cases the hydraulic pump is not designed such that with a simultaneously maximum volumetric flow demand of all consumers, sufficient supply of all consumers would be ensured.

In working operation, this limitation leads to the diesel engine being operated at its output limit and the pump flow rate in parallel operation of hydraulic consumers not being sufficient for the desired maximum working speeds. For safety functions, priority valves must be used to supply the preferred consumers first before delivery to other consumers is released. All other consumers must share the remaining flow.

For such construction machinery, the prior art t supplies the consumers by directional control valves with compensators connected upstream. The valve spools of the directional control valves determine the size of the opening of the metering orifices for supply of the consumers. Viewed from the pump, a series of variously high resistances is presented by the operating principle of the upstream compensators copying the pressure of the external loads to upstream from the metering orifices and still increasing it by the amount of force of their control springs. When the flow rate of the pump is insufficient, the pump pressure collapses, and the working medium flows over the path of least resistance. The consumer with the highest load can thus be shut down. Its "saved" volumetric flow is thus available to all other consumers.

For the machine operator, this system behavior is not acceptable since, for typical machine control with a joystick, several functions are run at the same time. If one consumer inadvertently stops, the operator will experience difficulties with the controls.

The attempt to solve this problem by using valves with compensators connected downstream from the metering orifice does not lead to the desired success, even though downstream compensators do not copy the load pressure to upstream from the metering orifice. The highest load pressure in the system is copied to downstream from the metering orifice, as a result of which, when the pump pressure collapses, all resistances remain the same viewed from the pump. Disadvantageously in these systems, the amount upstream from the metering orifice must be separated. This separation is not easily possible. Another particular disadvantage is that the load signaling system of directional control valves with downstream compensators dictates a continuous discharge flow from the controlled volumetric flow of the consumer with the highest load. This operation constitutes an energy loss.

SUMMARY OF THE INVENTION

An object of the invention is to provide a method for operating a hydraulic system with relatively improved operating behavior when the supply device is overtaxed.

According to the invention, this object is basically achieved by a method providing that when the consumer is undersupplied, all consumers in the hydraulic system are used to compensate for the volumetric flow deficit of the undersupplied consumer. In the prior art in systems with an upstream compensator in the case of undersupply, the consumer with the highest load can shut down and its saved volumetric flow then benefits the other consumers. The invention conversely calls for a correspondingly reduced volumetric flow to be made available to all consumers in the case of undersupply. Therefore, no danger exists that the machine operator controlling several consumers at the same time, in order to simultaneously run several functions, will be confronted with a situation in which one consumer is shut down while the other consumers continue to operate (remain in motion).

In embodiments in which a volumetric flow of pressurized fluid dependent on the size of the opening of an assigned adjustable metering orifice is supplied via the metering orifice from a pump delivery flow to each consumer, on the orifices a pressure difference is produced referenced to the size of the orifice opening and the pump flow rate. Preferably, when the pressure difference drops on at least one metering orifice to below a setpoint, a correction signal is produced. Depending on its signal value the size of the opening of all metering orifices is synchronously reduced. The correction signal is maintained until the setpoint of the pressure difference is reached again. The correction signal therefore is generated when the hydraulic pump is overtaxed. The pump flow rate is then no longer sufficient to produce the necessary dynamic pressure on the metering orifice of the consumer with the highest load, by which the pressure difference on this orifice drops below a specified setpoint.

Preferably, a synchronous pressure is produced in a synchronous channel as the correction signal. Since the correction signal is thus present in the form of a pressure signal, it is preferably caused to take effect directly in the valve system.

In especially preferred embodiments, the synchronous pressure is produced by a synchronous compensator supplied on the one hand with the pump pressure and on the other with the highest load pressure of the system plus the force of its control spring. When its control pressure difference is not reached, a pressure source is connected to the synchronous channel.

In embodiments in which the supply of the consumers is controlled by proportional directional control valves, whose valve spools can be triggered hydraulically for changing the metering orifices by sensor pressure, the synchronous pressure is supplied to the face side of the valve spools triggered with the sensor pressure. The synchronous pressure produced in operating states of undersupply therefore results in valve spools of all directional control valves being reset by an amount depending on the synchronous pressure against the respective sensor pressure. All consumers are then supplied with a correspondingly reduced volumetric flow for compensation of the undersupply.

In especially advantageous embodiments, the pressure difference on the metering orifices of the directional control valves are controlled by an assigned individual compensator, and the system pressure is controlled by a system compensator.

Accordingly, the differential pressure of the synchronous compensator is preferably set to a somewhat lower value than the differential pressure of the system compensator. This setting ensures that in normal operation of the system, the differential pressure in the system is definitively determined by the system compensator.

The pressure difference of the synchronous compensator is preferably set to the pressure difference of the individual compensators or higher.

In especially preferred embodiments, the system of valves and pumps is dimensioned such that at the maximum possible volumetric flow demand the maximum synchronous pressure does not exceed the pretensioning force of the centering springs of the valve spools. This arrangement ensures that in the case of undersupply of the system, the valve spools cannot be reset to their neutral position by the synchronous pressure.

In systems with consumers which, for example for reasons of safety, are especially preferred, the supply of the correction system to the respectively preferred consumer can be stopped by a priority circuit.

The subject matter of the invention is also a hydraulic system which can be operated according to this method.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
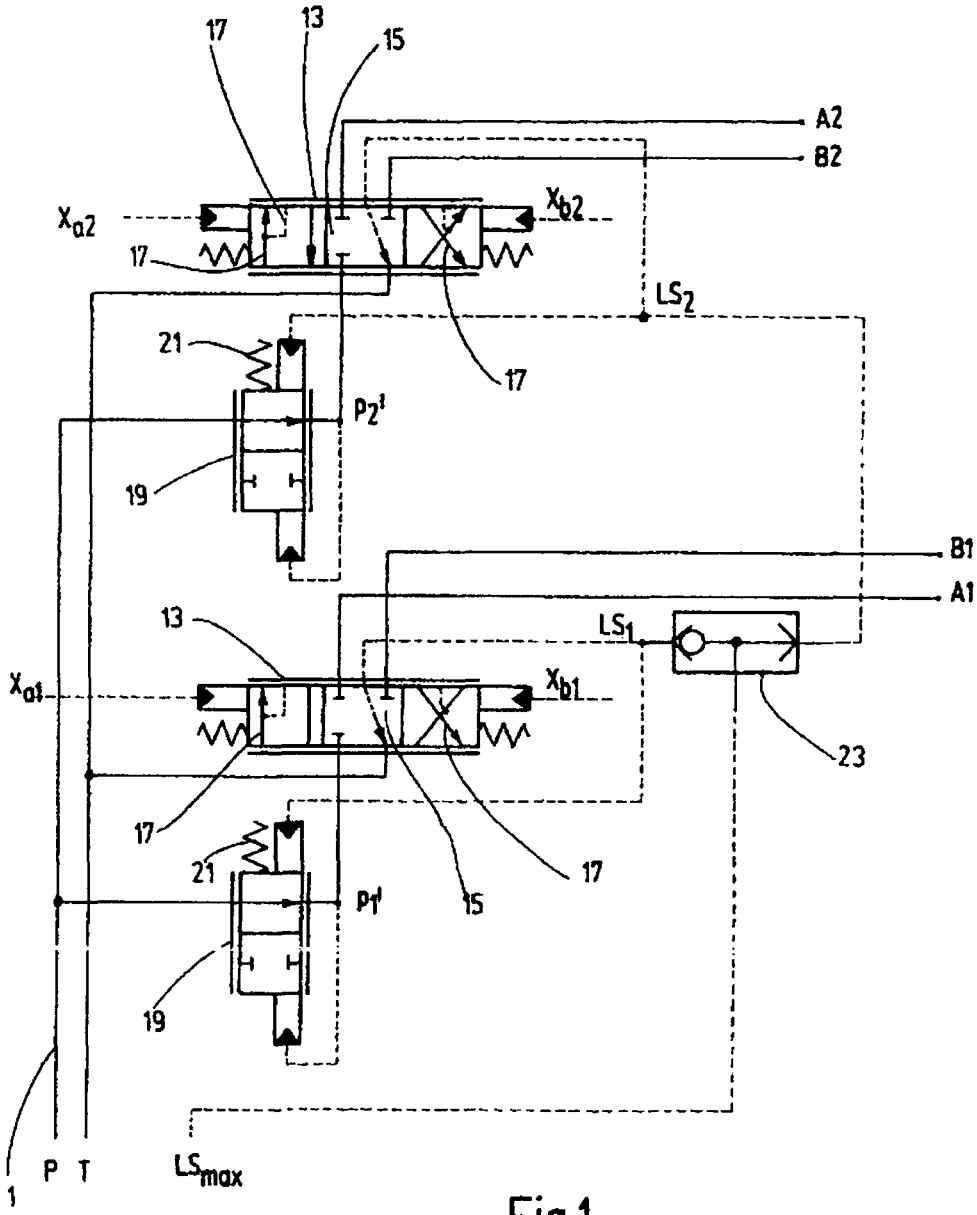
Fig.1 PRIOR ART
FIG. 1 is a schematic hydraulic circuit diagram of a prior art hydraulic system for supply of two hydraulic consumers.
Figure 2:
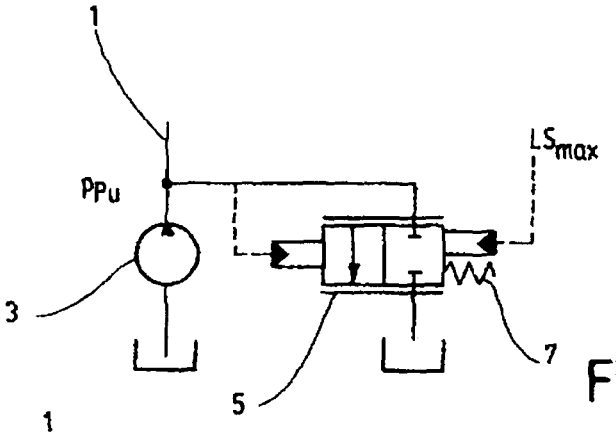
PRIOR ART Fig.2
FIGS. 2 and 3 are schematic hydraulic circuit diagrams of two different system pressure regulators for use in hydraulic systems of FIG. 1.
Figure 3:
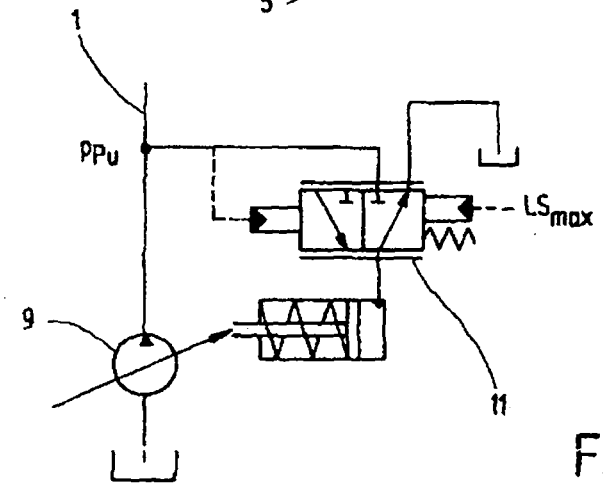
Fig.3 PRIOR ART

FIG. 1 shows a hydraulic system corresponding to the prior art for supply of two consumers (not shown). A system pressure regulator is connected upstream from the pump line 1. FIGS. 2 and 3 show two embodiments of system pressure regulators that can be used for hydraulic systems of the type shown in FIG. 1 to keep the pressure difference of the pump pressure and the maximum load pressure LSmax constant. FIG. 2 illustrates a hydraulic pump in the form of a constant delivery pump 3. The pump pressure side is connected to a three-way compensator 5 supplied with the pump pressure and with LSmax, plus the force of one control spring 7. Compensator 5 works as a pilot-controlled pressure limitation valve keeping constant the pressure difference between the pump line 1 and LSmax. FIG. 3 conversely shows the use of a variable delivery pump 9 whose controller is formed by a directional control valve 11 that adjusts the required flow rate within the control circuit "pump adjustment mechanism."

The supply of the consumers (not shown in FIG. 1) by the supply lines A1, B1 and A2, B2 takes place by way of proportional directional control valves 13. The valve spools 15 of control valves 13 with their metering edges define the sizes of the openings of metering orifices 17. One individual compensator 19 is connected upstream from the respective directional control valve 13 supplied conventionally for upstream compensators with the dynamic pressure p1' and p2' prevailing on the respective metering orifice 17 of the directional control valve 13 and with the loading pressure of the pertinent consumer $LS_1$ and $LS_2$ plus the force of its control spring 21. A selector valve 23 to which the load pressures $LS_1$ and $LS_2$ are supplied decides which load pressure is supplied as LSmax to the system pressure regulator (not shown in FIG. 1). For controlling the volumetric flows supplied to the consumers by the supply lines A1, B1 and A2 and B2, the control valves 13 can be triggered hydraulically by a sensor pressures $X_{a1}$ and $X_{a2}$ supplied to the face side of the respective valve spool 15 or a sensor pressure $X_{b1}$ and $X_{b2}$ being supplied to the opposite face side thereof.

If the pump pressure collapses when the pump output is overtaxed during operation of the system shown in FIG. 1, on the individual compensator 19 with the highest load pressure, only a reduced pressure difference as a pressure excess for controlling the pressure difference is available on the pertinent metering orifice 17. If this dynamic pressure on the most highly loaded directional control valve 13 drops to the load pressure or below, this consumer stops while the consumers under a low load continue to move.

Figure 4:
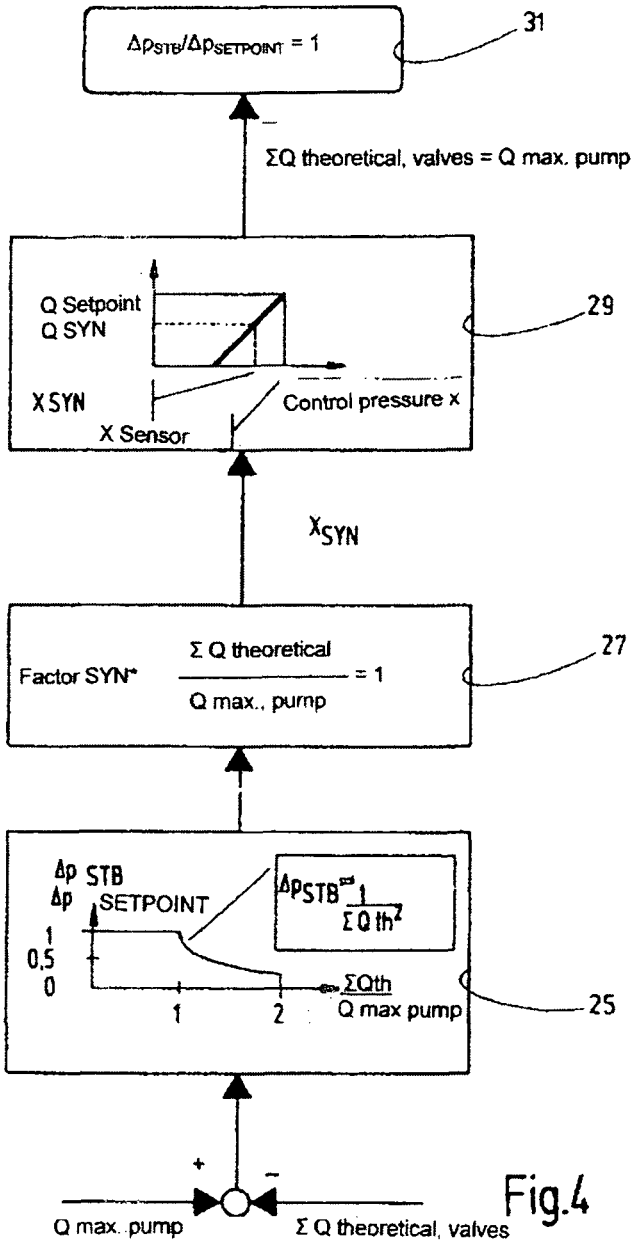
FIG. 4 is a flow chart illustrating the operating principle of the invention.

FIG. 4 illustrates the different state arising by the method according to the invention. If the directional control valves 13 during system operation are opened to the extent that the pump flow rate is no longer sufficient to throttle the necessary dynamic pressure upstream from the metering orifices 17, the dynamic pressure then drops according to a quadratic function, see box 25 (first box from the bottom). In the next box 27 to the top, the control law of a synchronous compensator (33 in FIG. 5) reduces again the volumetric flow demanded by the consumers down to the possible pump flow rate by the correction signal in the form of a synchronous pressure $X_{syn}$ constituting compensation of the control pressures prevailing on the valve spools 15. The compensating synchronous pressure $X_{syn}$ opposes the control pressures X, see box 29, and thus reduces the opening cross sections of all metering orifices 17. This operation takes place until the differential pressure setpoint which is set on the synchronous compensator 33 is reached again, see box 31.

Figure 5:
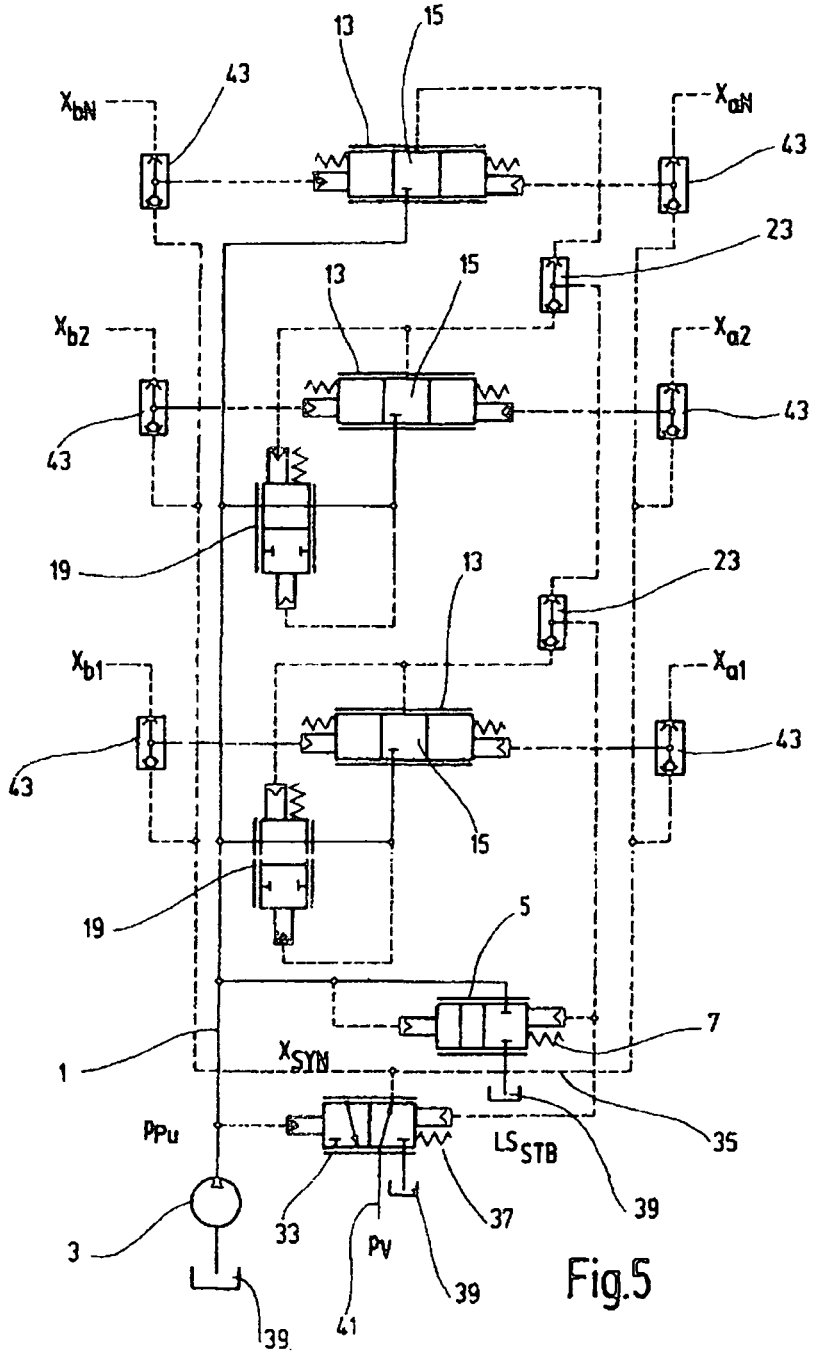
FIG. 5 is a schematic hydraulic circuit diagram of the hydraulic system according to an exemplary embodiment of the invention designed for implementing the method according to an exemplary embodiment of the invention.

FIG. 5 illustrates the method according to an exemplary embodiment of the invention using a hydraulic system with three-way directional control valves 13 for supplying three consumers. The supply lines are omitted, and the directional control valves 13 are shown simplified for the sake of clarity. One individual compensator 19 in the same arrangement as shown in FIG. 1 is connected upstream from two of directional control valves 13. The directional control valve 13 for the consumer N is integrated into the system without an individual compensator. The system pressure is regulated according to the example of FIG. 2 by a three-way compensator 5 connected to the pump line 1 at the output of the constant delivery pump 3.

The synchronous compensator 33 used to produce a synchronous pressure $X_{syn}$ in a synchronous channel 35 is supplied with the pump pressure and with the maximum control block load pressure $L_{STB}$ plus the force of a control spring 37. The choice of which load pressure is supplied as the maximum load pressure $L_{STB}$ both to the synchronous compensator 33 and to the system compensator 5 takes place as in the system of FIG. 1 by selector valves 23.

The synchronous compensator 33 works as the pump regulator in a control circuit in which the valve spools 15 of all directional control valves 13 participate. The basic principle is a sensor circuit monitoring the level of the current pressure difference on the control block (directional control valve 13). If this pressure difference is in the specified region, the synchronous compensator 33 remains passive, i.e., it is pressed by the desired pressure difference against its control spring 37 and relieves the synchronous channel 35 after the tank 39. In the other case, the synchronous compensator 33 assumes an open position and supplies from the supply line 41 the volumetric flow into the synchronous channel 35 to produce a synchronous pressure X. The synchronous channel 35 can be connected in parallel to each face side of all valve spools 15, the decision—supply of control pressure/sensor pressure—being made by the respective selector valve 43 to which on the one hand the sensor pressure X . . . on the one hand and the synchronous pressure $X_{syn}$ on the other are supplied.

If the synchronous pressure Xsyn rises and pushes through to the face side of the valve spool 15, it can be assumed that it is that side of the valve spool 15 opposite the side triggered with the sensor or pilot pressure. If, for example, a directional control valve 13 is triggered with 7 bar and delivers 50 l/min and at this point, the synchronous pressure rises from 0 to 2 bar, the spool 15 deflected with 7 bar is reset to the spool position corresponding to 5 bar control pressure by 2 bar counterpressure. As a result, the volumetric flow supplied to the consumers is reduced. The corresponding applies to the valve spools 15 of the directional control valves 13 of the other consumers. The synchronous pressure is built up, i.e., the synchronous compensator 33 remains in the open position until the desired pressure difference on the control block has again reached the setpoint.

The differential pressure of the synchronous compensator 33 is set somewhat lower than the differential pressure of the system pressure regulator. In normal saturated operation, the differential pressure in the system is then definitively determined by the system pressure regulator. The differential pressure of the individual compensators 19 is ideally set to the value of the pressure difference of the synchronous compensator 33. Then, the synchronous compensator 33 recognizes incipient undersaturation of the system compensator 5, while the individual compensators 19 are still saturated. For incipient undersupply, this method does not cause any errors in synchronous control since, before the individual compensators 19 would completely open due to incipient undersaturation and then could no longer regulate, the synchronous compensator 33 already begins to produce a compensating synchronous pressure $X_{syn}$ to reset all deflected valve spools 15.

Figure 6:
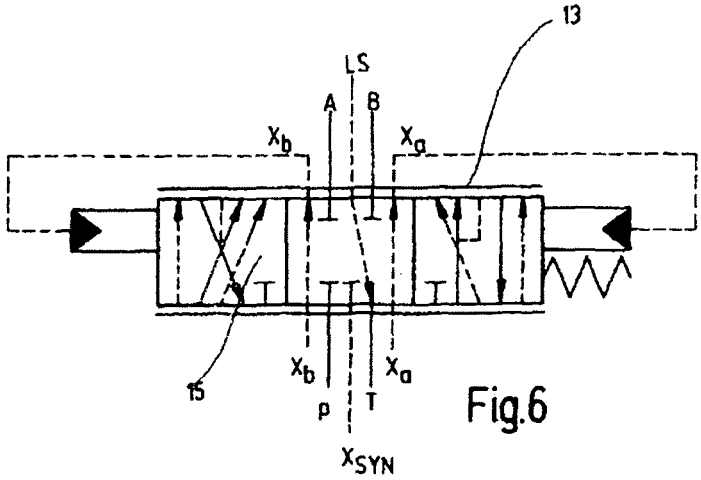
FIG. 6 is a schematic operating diagram of a directional control valve for the synchronous control method according to an exemplary embodiment of the invention and with a logic circuit for triggering with synchronous pressure.

As alternatives to using the selector valves 43, according to FIG. 6, a logic circuit on the valve spool 15 of the directional control valves 13 can choose to what face side the sensor pressure or synchronous pressure is supplied.

Figure 7:
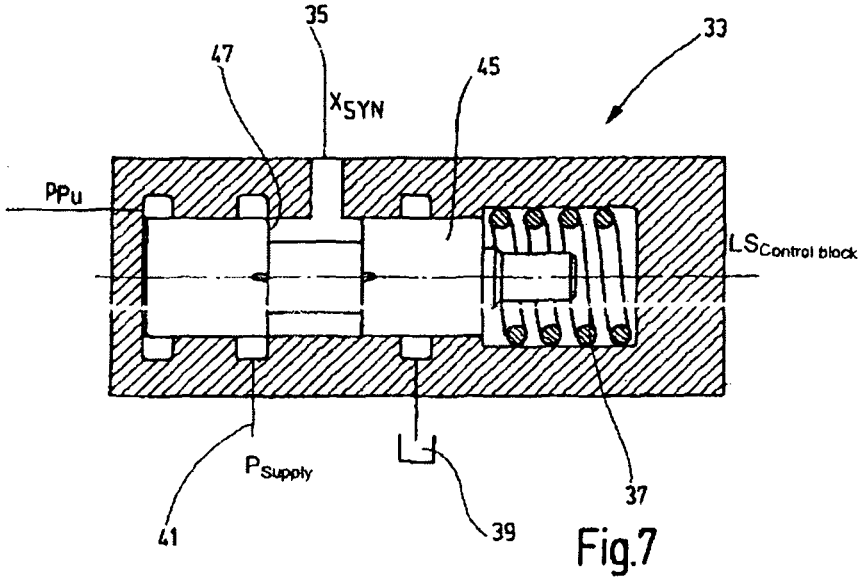
FIG. 7 is a schematically simplified side elevational view in section of a synchronous compensator according to an exemplary embodiment of the invention.

FIG. 7 shows a cross section of the synchronous compensator 33 whose spool 45 is shifted so far to the left by the load pressure LS and the force of the control spring 37 in the figures that the metering edge 47 begins to connect the supply line 41 to the synchronous channel 35, while the connection to the tank 39 is cut off. When the pressure $P_{pu}$ rises until the desired differential pressure is reached and the spool 45 is reset to the right, the synchronous channel 35 is relieved again to the tank 39.

If in this text orifices such as metering orifices are addressed, the pertinent details also apply to throttles such as metering throttles. These details also apply to the nozzles used.

While one embodiment has been chosen to illustrate the invention, it will be understood by those skilled in the art that various changes and modifications can be made therein without departing from the scope of the invention as defined in the appended claims.

What is claimed is:

1. A method for operating a hydraulic system comprising the steps of:

supplying a volumetric flow of pressurized fluid from at least one hydraulic pump to each of different hydraulic consumers via respective adjustable metering orifices depending on opening sizes thereof;

controlling the supply of the volumetric flow of the pressurized fluid by selectively supplying respective pilot pressures to respective face sides of respective valve spools of directional control valves, to change the respective opening sizes of respective metering orifices;

when at least one of the hydraulic consumers is undersupplied in volumetric fluid flow, sharing equally a deficit in the volumetric flow to the at least one hydraulic consumer with at least one other of the hydraulic consumers, by selectively supplying a synchronous pressure, generated by a synchronous compensator, to respective face sides of the respective valve spools of the at least one other of the hydraulic consumers, which reduces the opening size of the respective metering orifices of the at least one other of the hydraulic consumers; and one of selector valves and a hydraulic logic circuit selectively supplying the pilot pressure and the synchronous pressure to respective face sides of the respective valve spools.

2. A method according to claim 1 wherein the synchronous pressure is supplied until the at least one of the hydraulic consumers is no longer undersupplied in volumetric fluid flow.

3. A method according to claim 2 wherein the synchronous pressure is produced in a synchronous channel by the synchronous compensator supplied with pressurized fluid from the pump and with a highest load pressure of the hydraulic system plus a biasing force of a control spring of the synchronous compensator; and when a control pressure difference between the pressurized fluid from the pump and the highest load pressure plus the biasing force is less than a certain value, a pressure source is connected to the synchronous channel.

4. A method according to claim 3 wherein the directional control valves are proportional directional control valves;

the synchronous pressure is supplied to the respective face sides of respective valve spools of the proportional directional control valves not operated with the pilot pressure.

5. A method according to claim 4 wherein pressure differences across the respective metering orifices of the directional control valves control respective pressure compensators, and a system compensator controls pressure of the hydraulic system.

6. A method according to claim 5 wherein the certain value is at a lower value than a differential pressure for switching of the system compensator.

7. A method according to claim 6 wherein the certain value is at least equal to the respective pressure differences for switching the individual pressure compensators.

8. A method according to claim 5 wherein the certain value is at least equal to the respective pressure differences for switching the individual pressure compensators.

9. A method according to claim 4 including dimensioning the directional control valves and at least one hydraulic pump such that at a set maximum possible volumetric flow demand, a maximum synchronous pressure occurs that does not exceed set pretensioning forces of centering springs of the valve spools of the proportional direction control valves.

10. A method according to claim 1 wherein the synchronous compensator produces the synchronous pressure and is supplied with pressurized fluid from the pump and with a highest load pressure of the hydraulic system plus a biasing force of a control spring of the synchronous compensator.

* * * * *